United States Patent [19]

Oloman et al.

[11] 4,118,305

[45] Oct. 3, 1978

[54] APPARATUS FOR ELECTROCHEMICAL REACTIONS

[75] Inventors: Colin William Oloman; Alan Paul Watkinson, both of Vancouver, Canada

[73] Assignee: Canadian Patents and Development Limited, Ottawa, Canada

[21] Appl. No.: 704,688

[22] Filed: Jul. 12, 1976

Related U.S. Application Data

[63] Continuation-in-part of Ser. No. 540,533, Jan. 13, 1975, Pat. No. 3,969,201.

[51] Int. Cl.[2] ..... C25B 1/30; C25B 9/00

[52] U.S. Cl. ..... 204/265; 204/1 R; 204/82; 204/83; 204/95; 204/269; 204/277

[58] Field of Search ..... 204/1 R, 222, 257, 263, 204/149, 152, 130, 265, 151, 82, 83, 95, 269

[56] References Cited

U.S. PATENT DOCUMENTS

| | | | |
|---|---|---|---|
| 3,716,459 | 2/1973 | Salter et al. | 204/1 R |
| 3,755,114 | 8/1973 | Tarajanyi et al. | 204/114 |
| 3,761,383 | 9/1973 | Backhurst et al. | 204/268 |
| 3,764,499 | 10/1973 | Okubo et al. | 204/151 |
| 3,899,405 | 8/1975 | Iverson et al. | 204/149 |
| 3,945,892 | 3/1976 | James et al. | 204/1 R |

*Primary Examiner*—Arthur C. Prescott
*Attorney, Agent, or Firm*—Fisher, Christen & Sabol

[57] ABSTRACT

A novel electrolytic cell is described for carrying out electrochemical reactions in which a gas and a liquid electrolyte flow co-currently through a fluid permeable conductive mass which acts as an electrode. The cell has an anode and cathode in spaced apart relationship, with one electrode being in the form of a fluid permeable conductive mass e.g. a porous matrix or a packed bed of graphite particles, separated from the counter electrode by a barrier wall. This barrier wall can be either anion specific membrane dividing the cell into separate cathode and anode chambers or a porous insulating wall permitting flow of electrolyte between the cathode and anode. A liquid electrolyte and a gas are passed co-currently through the electrode bed perpendicular to the current flow and the reaction product is generated in the solution within the electrode bed.

9 Claims, 7 Drawing Figures

APPARATUS FOR ELECTROCHEMICAL REACTIONS

BACKGROUND OF THE INVENTION

1. Field of the Invention

This invention relates to an electrolytic cell for carrying out electrochemical reactions in which a gas and a liquid electrolyte flow co-currently through a fluid permeable conductive mass which acts as an electrode. It is continuation-in-part of application Ser. No. 540,533, filed Jan. 13, 1975 now U.S. Pat. No. 3,969,201.

2. Description of the Prior Art

The literature contains description of fixed bed electrodes with single phase flow and of the use of gas to promote turbulences in the electrolyte between conventional plate electrodes. Packed bed electrodes have been considered unsuitable for reactions that generate gases because the presence of gas is supposed to raise the cell resistance to unacceptable levels. However gas and liquid flow is commonplace in conducting chemical (as opposed to electrochemical) reactions where a liquid and gas must be contacted simultaneously with a solid catalyst. Such reactors, with co-current, downward flow of liquid and gas through a bed of catalyst particles, are called "TRICKLE BED" reactors.

Apart from the effect of the gas on cell resistance, the difference between the chemical and electrochemical processes in this connection is that in the chemical system the reaction occurs over the whole of the accessible catalyst surface, no matter how large the catalyst bed, whereas in the electrochemical system the reaction only occurs over a narrow section of the bed (up to about 2 cm.) nearest the counter electrode and normal to the direction of current flow.

Thus there is no simple analogy between chemical and electrochemical systems involving gaseous reactants, and in the prior art the electrochemical reaction of gases has been achieved either by bubbing the gas between plate electrodes or by contacting the gas and liquid electrolyte across a porous "gas diffusion" electrode.

There are several disadvantages to these techniques that work against their exploitation in commercial processes. In the case of plate electrodes the electrode area is generally too low to carry out reactions requiring low current densities (such as with gases of low solubility) while coalescence of the gas bubbles above about 2 ft of electrolyte depth gives relatively low mass transfer rates as well as raising the cell resistance to impractical levels. This latter effect is particularly bad with narrow electrode gaps so that the usual benefits of narrow gaps can not be obtained in gas sparged systems. Furthermore, the high degree of liquid backmixing in gas sparged plate cells is inappropriate for processes in which the desired product is the intermediate in a series of chemical or electrochemical reaction.

Gas diffusion electrodes overcome the problem of electrode area by using extremely porous materials with real surface areas of the order of 1000 $m^2/gm$. Apart from being difficult to fabricate these electrodes are susceptable to contamination and to deactivation by plugging or by flooding of the pores with liquid. To avoid flooding it is necessary to use special water proofed electrodes and/or to balance the liquid and gas pressure across the porous plate, which causes operating difficulties and limits the useful size of the electrodes. Also, there are problems associated with operating gas diffusion electrodes in the bi-polar mode and with cell construction to avoid unwanted reactions at the counter electrode.

A typical problem in this field is in the design of a reactor for the electroreduction of oxygen gas to hydrogen peroxide.

Recent designs of electrolytic cells for the reduction of oxygen to peroxide are described in Grangaard, U.S. Pat. Nos. 3,454,477; 3,507,769; 3,459,652 and 3,592,749. Grangaard used as an electrode a porous carbon plate with the electrolyte and oxygen delivered from opposite sides for reaction on the plate. His porous gas diffusion electrode requires careful balancing of oxygen and electrolyte pressure to keep the reaction zone evenly on the surface of the porous plate.

Another feature of the Grangaard cell is that it contains an anode and a cathode chamber separated by a semi-pervious diaphragm and requires the flow of electrolyte from the anode to the cathode chamber under a small hydrostatic head, to present the reaction of peroxide on the anode, and a double pass electrolyte feed arrangement as described in U.S. Pat. No. 3,592,749. This has several disadvantages:

1. It complicates the construction of the cell;
2. It increases the electrical resistance of the cell by the resistance of the liquid in the anode chamber;
3. It complicates the operation of the cell, insofar as the flow of both gas and electrolyte must be continuously balanced for the proper condition to prevail in the cathode chamber. This becomes particularly difficult with flow arrangement as illustrated in U.S. Pat. No. 3,592,749;
4. The gas generated at the anode must be collected and pumped back to the cathode.

It is the object of the present invention to provide a simplified and improved electrolytic cell for carrying out electrochemical reactions involving a gas and a liquid electrolyte.

SUMMARY OF THE INVENTION

The electrochemical cell comprises a pair of spaced apart electrodes, at least one of said electrodes being in the form of a fluid permeable conductive mass separated from the counter electrode by a barrier wall. Inlets are provided for feeding liquid electrolyte and gas into the electrode mass such that the electrolyte and gas move co-currently through the electrode mass in a direction perpendicular to the direction of the current between the electrodes and outlet means are provided for removing solutions containing reaction products from the fluid permeable conductive mass. The conductive mass can conveniently have a thickness of about 0.1 and 2.0 cm. in the direction of current flow.

The electrode mass can be in the form of a bed of particles or a fixed porous matrix. It is composed of a conducting material which is a good electrocatalyst for the reaction to be carried out.

For the reduction of oxygen to peroxide, graphite has been found particularly suitable for the cathode mass because it is cheap and requires no special treatment. For other reactions graphite or other forms of carbon or tungsten carbide may be used as well as certain metals, such as platinum, iridium, gold etc., or metal oxides such as lead dioxide or manganese dioxide coated on a conducting or non-conducting substrate. In particulate form the particles typically have diameters in the range of about 0.005 to 2.0 cm. This bed of particles is made to act as the electrode in electrochemical reactions.

The so-called "barrier wall" is a physical insulating barrier which prevents the cathode particles from coming into actual contact with the anode. It may be an ion specific membrane of it may be a simple insulating mechanical separator which permits flow of electrolyte and the passage of gas between the cathode and anode. This can conveniently be a plastic fiber cloth or the like, for example polypropylene, which is compressed against the counter electrode plate by the electrode bed or held apart from it to form a separate electrolyte chamber. Of course a variety of materials can be used for making the porous insultating sheet provided they can withstand attack by electrolyte solutions and have high electrical resistance, e.g. asbestos, etc. If compressed against the counter electrode, preferably the porous insulating sheet has an air permeability when dry between about 10 and 100 SCFM/ft$^2$ at $\frac{1}{2}$ inch water gauge pressure differential.

According to other preferred features, the cathode bed has a thickness of about 0.1 to 2.0 cm. in the direction of current flow and a length in the direction of travel of electrolyte of about 0.3 to 3 meters.

The electrolytic cell according to this invention has been found to be particularly useful for processes involving gaseous reactants with low solubility in the electrolyte. It is also useful for any electrochemical process requiring a low real current density, in which the co-current flow of gas improves the efficiency of the electrode reactions.

For instance, it can be used for reduction processes such as the reduction of oxygen to peroxide and the reduction of sulphur dioxide to produce sodium dithionite. In other reactions, the gas may be an inert gas with the cell being used to provide a low current density, e.g. for the production of sodium hypochlorite from dilute sodium chloride solutions.

It was quite unexpectedly found, for instance in the production of peroxides using a porous barrier wall compressed against the anode that the peroxide formed on the cathode is not entirely destroyed on the anode and a reasonable current efficiency for peroxide production can be maintained even though the electrolyte is allowed to circulate between the cathode and the anode. This allows for great simplification in reactor design and a decrease in operating costs. Moreover, it has been found that with this system it is possible to obtain a product peroxide concentration of greater than 3% from a single pass of the electrolyte through the reactor.

According to an alternative arrangement, the barrier wall can be in the form of a cation specific membrane which forms separate cathode and anode chambers. There are then separate anolyte and catholyte flows through the two chambers.

The system may be operated at a superatmospheric gas pressure, e.g. in the range of about 1.0 to 30 atmospheres absolute, and this high pressure, together with the turbulent action of the gas and the electrolyte through the electrode bed permits the use of quite high superficial current densities, e.g. in the range of $10^{-3}$ to 1.0 Amp. cm$^{-2}$.

The operating temperature can conveniently be in the range of 0°–80° C. Increased temperatures tend to lower the solubility of the gas in the catholyte, but increase the electrolyte conductivity.

There are a number of general advantages to the system of the invention, as follows:

(i) The flow of gas together with liquid enhances the mass transfer in the electrode and thus allows the use of higher current densities than would be possible with the liquid alone at a given flow rate.

(ii) The gas can supply a reactant for the electrode process.

(iii) The presence of gas decreases the liquid hold up in the electrode and thus suppresses the loss of current efficiency due to unwanted side reactions.

(iv) The flow of gas helps to cool the reactor by evaporation.

Moreover, for the production of peroxide from oxygen there are specific advantages in the system of the present invention over the systems described in the prior art as exemplified by the Grangaard patents. Thus, the cell of the present invention is much simpler in design as compared with the previous cells and it can produce a solution containing more than 3% of hydrogen peroxide with an $NaOH/H_2O_2$ ratio of 2/1. This ratio is critical to the commercial use of this solution in pulp bleaching and compared with a peroxide concentration from the Grangaard cell of only 0.5% with an $NaOH/H_2O_2$ ratio of 4/1. Moreover, the high pressures possible with the system of this invention permits much higher superficial current densities than are permissible with the Grangaard cell. The cathode material used in the present unit is cheaper and more readily available than those described in the prior art and with a single pass electrolyte flow, where it is not necessary to separate the catholyte from the anolyte, no problems of alkalinity build up in the anolyte or sodium ion build up in the catholyte occur. This is a prevailing problem in the prior art systems and, for instance, in U.S. Pat. No. 3,592,749 Grangaard required a complicated double-pass electrolyte flow arrangement to overcome the problem.

DESCRIPTION OF THE PREFERRED EMBODIMENTS

Certain specific embodiments of this invention will now be illustrated by reference to the following detailed description and accompanying drawings wherein.

Figure 1:
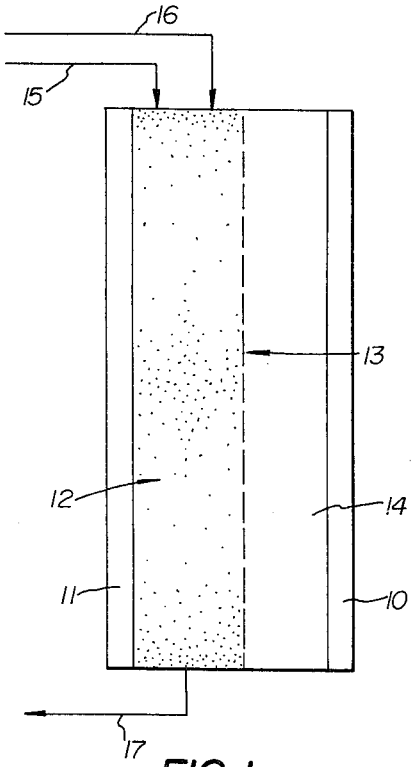
FIG. 1 is a schematic cross-sectional view of a cell for electrochemical reactions in accordance with the invention.

FIG. 1 is a general schematic illustration of the cell according to the invention showing the main components in simplified form. It includes a pair of current carriers 10 and 11 which are preferably metal plates and adjacent current carrier 11 is a fluid permeable conductive mass 12 which can be a fixed porous mass or a bed of discreet particles. On the opposite side of the conductive mass 12 is an insulating barrier 13 which can be a porous plastic fabric or an ion specific membrane. Between the barrier 13 and the current carrier 10 is a gap 14 but it is also possible for the barrier 13 to be in actual contact with the current carrier 10. With this arrangement the conductive mass 12 becomes one electrode while the current carrier 10 then becomes the counter electrode.

A stream of liquid electrolyte 15 and gas 16 are fed in co-currently from the top of the cell and the product is removed through the bottom outlet 17.

Figure 2:
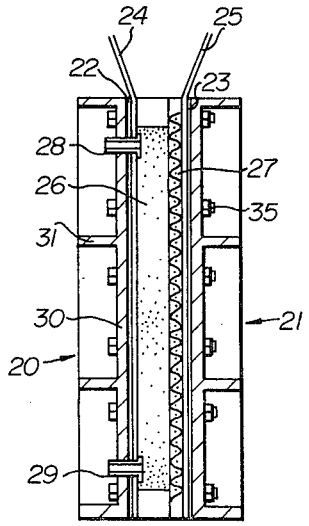
FIG. 2 is a cross-sectional view of one preferred arrangement of the cell shown in FIG. 1.

A specific preferred embodiment is illustrated in FIG. 2 and this shows a single cell sandwiched between a pair of compression plates 20 and 21. Immediately adjacent these compression plates are insulating layers 22 and 23, these being followed by a 304 stainless steel cathode current conductor 24 and a 304 stainless steel anode plate 25 respectively. Within the gap between the plates 24 and 25 is a cathode bed composed of graphite particles (UCAR Type No. 1 available from Union Carbide Corporation) in the size range 0.42 to 0.30 mm. Position between this cathode bed 26 and anode 25 is a diaphragm of felted polypropylene (National Felt Company Type PP15) with a permeability of 25–35 SCFM/ft$^2$ at ½ inch W.G. An inlet 28 and an outlet 29 are provided for flow through the cathode bed 26.

Figure 3:
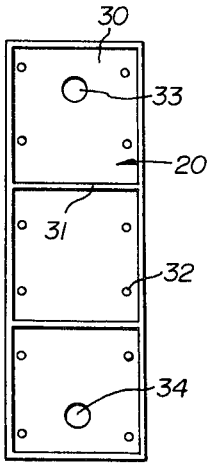
FIG. 3 is a side elevation of the cell shown in FIG. 2.

The compression plate 20 is shown in greater detail in FIG. 3 and includes a flat base plate 30 with upstanding reinforcing webs 31. The base plate 30 includes a series of bolt holes 32 as well as an inlet opening 33 and an outlet opening 34.

Figure 4:
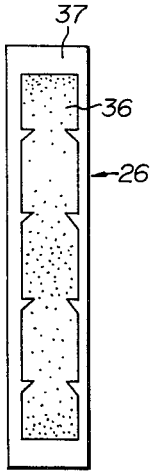
FIG. 4 is a side elevation of a graphite cathode bed.

The cathode bed is shown in greater detail in FIG. 4 and it will be seen that the cathode bed is retained at the top, bottom and sides between plates 24 and 25 by means of a surrounding casket 37 made from "Durabla" impregnated asbestos.

Figure 5:
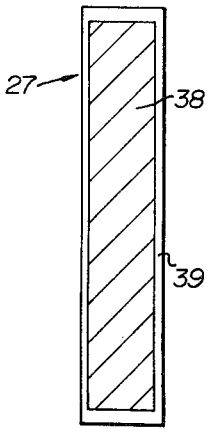
FIG. 5 is a side elevation of a barrier wall.

The barrier wall 27 is shown in greater detail in FIG. 5 and it will be seen that the felted polypropylene material 38 is surrounded by an edge gasket 39 which engages the edge gasket 37 of the cathode bed so that when the entire unit is assembled as shown in FIG. 2 the internal flow region of the cell is enclosed by these caskets. Of course, the entire unit is held together between the compression plates by means of the series of bolts 35 which pass through the holes 32 in the compression plates.

The cell of FIGS. 2–5 has dimension 50 cm long by 5 cm wide with an active superficial area of about 230 cm$^2$. The thickness of the cathode bed is ⅛ inch.

Figure 6:
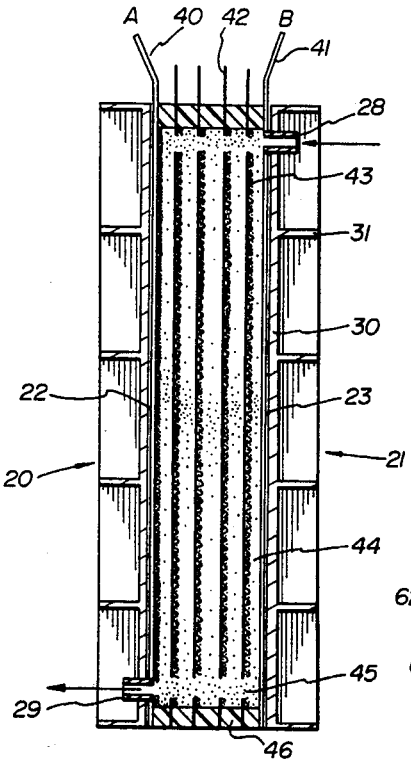
FIG. 6 is a cross-sectional view of another preferred embodiment of the cell.

FIG. 6 illustrates a unit with five cells, using bi-polar electrodes. This cell is generally constructed as shown in FIG. 2 with the same compression plates 20 and 21 but in place of the single cathode bed of FIG. 2, there is positioned between the terminal electrodes 40 and 41 a series of five cathode beds. These are formed by means of four intermediate electrode plates 42 formed from 1/32 inch thick 304 stainless steel with appropriate holes 45 for gas and liquid distribution between the cells. Adjacent each intermediate electrode plate 42 is a barrier wall 43 formed from a woven polypropylene cloth available from the Wheelabrator Corp. Type S4140 enclosed within a neoprene peripheral gasket. The space adjacent each barrier wall is filled with graphite particles 44 as described in FIG. 2. Again the top and bottom and side edges are enclosed by neoprene gaskets so as to provide a series of parallel cells to which the liquid electrolyte and gas flow from inlet 28 to outlet 29.

The cell of FIG. 6 has dimensions 76 cm long by 5 cm wide with an active superficial area of about 350 cm$^2$ per cell. Current delivered through the terminal electrodes 40 and 41 passes through each cell in series with the other plates acting as bi-polar electrodes.

Figure 7:
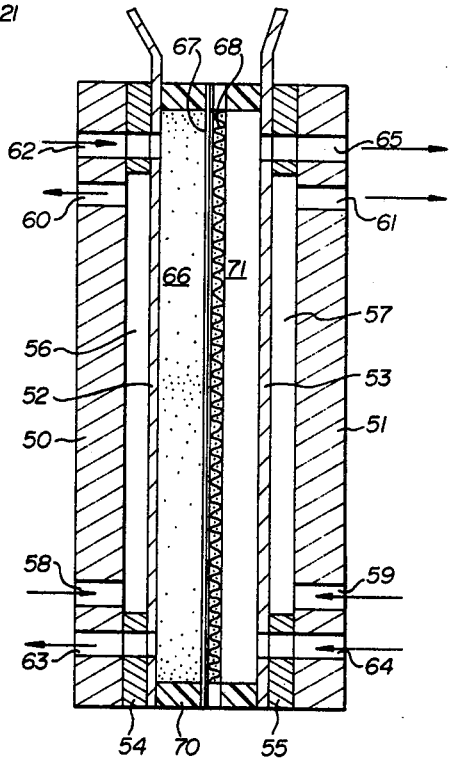
FIG. 7 is a cross-sectional view of yet another embodiment of the cell.

Another embodiment of the cell is shown in FIG. 7. This includes a pair of ¾ inch thick mild steel compression plates 50 and 51 with a lead cathode feeder plate 52 and a stainless steel anode plate 53. These electrodes are spaced from the compression plates by means of peripheral spacers 54 and 55 forming water cooling chambers 56 and 57. The chamber 56 has a water inlet 58 and a water outlet 60 while the chamber 57 has a water inlet 59 and a water outlet 61. Between the electrodes 52 and 53 are positioned a membrane support screen 67 and a cation specific membrane (AMF, Type C100) with a gap between screen 67 and electrode 52 being filled by tungsten carbide particles in the size range 0.42–0.30 mm and the gap 71 between membrane 68 and electrode 53 being empty. The cathode region 66 and the gap 71 are enclosed by means of peripheral gaskets 70.

With this design reactants are fed in through inlet 62 and these travel co-currently down through the cathode bed 66 and out through product outlet 63. An anolyte liquid is passed in a reverse flow through lower inlet 64 up through the gap 71 and out through anolyte outlet 65.

The following examples are given to illustrate the invention but are not deemed to be limiting thereof.

EXAMPLE 1

A cell was prepared according to FIGS. 2 to 5 and was used to produce alkaline peroxide solution by electroreduction of oxygen. A single electrolyte solution of sodium hydroxide in water was passed together with oxygen gas through the inlet 28, down through the cathode bed 26 and out through outlet 29. The reaction was carried out under the following conditions:

| | |
|---|---|
| Sodium hydroxide feed concentration | 2M |
| Gas feed composition | 99.5% $O_2$ |
| Electrolyte flow | 10 cm$^3$/min |
| Oxygen flow | 1500 cm$^2$/min S.T.P. |
| Inlet pressure | 10 Atm Absolute |
| Outlet pressure | 9.6 Atm Absolute |
| Inlet temperature | 20° C |
| Outlet temperature | 30° C |
| Current | 30 Amp (= .13A/cm$^2$) |
| Voltage across cell | 1.9 Volt |

The electrolyte leaving the cell contained 0.62 Molar hydrogen peroxide, corresponding to a current efficiency for peroxide production of 67% and power consumption of 2Kwhr/lb of $H_2O_2$.

EXAMPLE 2

An alkaline peroxide solution was also prepared using the five cell unit shown in FIG. 6. The electrolyte and oxygen were distributed by the manifold to flow through all five cells in parallel and the operating conditions were as follows:

| | | | | | |
|---|---|---|---|---|---|
| Sodium hydroxide feed concentration | | | 2M | | |
| Gas feed composition | | | 99.5% $O_2$ | | |
| Electrolyte flow (total) | | | 55 cm$^3$/min | | |
| Oxygen flow (total) | | | 7500 cm$^3$/min S.T.P. | | |
| Inlet pressure | | | 11 Atm. | | |
| Exit pressure | | | 7 Atm. | | |
| Exit temperature | | | 46° C | | |
| Current | | | 30 Amp (= 0.086 A/cm$^2$) | | |
| Voltage | Cell 1 | 2 | 3 | 4 | 5 |
| | 1.61 | 1.57 | 1.59 | 1.52 | 1.64 |

Electrolyte leaving the cell contained 0.65 M peroxide, corresponding to a current efficiency of 78% and a power consumption of 1.44 Kwhr/lb $H_2O_2$.

EXAMPLE 3

The cell illustrated in FIG. 7 was used for the production of sodium dithionite by electro-reduction of sulphur dioxide.

The reactor was operated with a feed of water together with a gas mixture of nitrogen and sulphur dioxide being fed in through inlet 62 and a solution of sodium hydroxide along to the anode chamber through the anode chamber inlet 64. The conditions in the cathode bed were as follows:

| | |
|---|---|
| Feed gas composition | $N_2$ - 80% by vol.<br>$SO_2$ - 20% by vol. |
| Feed gas flow | 1000 $cm^3$/min S.T.P. |
| Feed water flow | 32.5 $cm^3$/min |
| Inlet pressure | 1.6 Atm. absolute |
| Exit pressure | 1.0 Atm. absolute |
| Exit temperature | 12° C |
| Current | 10 Amp |
| Voltage across cell | 3.2 volt |

The concentration of sodium dithionite ($Na_2S_2O_4$) in the exit solution from the cathode was 11.8 gram/liter, corresponding to a current efficiency of 71%, a yield of dithionite from $SO_2$ of 49% and a power consumption of 1.33 Kwhr/Kg of sodium dithionite.

The embodiments of the invention in which an exclusive property or privilege is claimed are defined as follows:

1. An apparatus for carrying out electrochemical reactions involving gaseous reactants comprising an undivided electrochemical cell having a pair of spaced apart electrodes, at least one of said electrodes being in the form of a fluid permeable conductive mass and being separated from the counter electrode by a porous insulating layer which is compressed between the conductive mass and the counter electrode thereby defining a flow path which permits free flow of gas and liquid between the electrodes and which providing electrical insulation between the conductive mass and the counter electrode, inlet means for feeding a liquid electrolyte and a gas into said fluid permeable conductive mass and outlet means for removing solutions containing reaction products from said conductive mass, said inlet and outlet being arranged whereby the electrolyte and gas move co-currently through the conductive mass in a direction normal to the flow of electric current between the electrodes.

2. Apparatus according to claim 1 in which the thickness of the fluid permeable conductive mass in the direction of current flow is about 0.1 cm of 2.0 cm.

3. Apparatus according to claim 1 in which the electrode mass is in the form of a bed of conductive particles.

4. Apparatus according to claim 3 in which the conductive particles are in the size range of about 0.005 cm to 2 cm.

5. Apparatus according to claim 1 in which the length of the electrode mass in the direction of liquid flow is from about 0.3 to 3.0 meters.

6. Apparatus according to claim 1 in which the permeability of the porous insulating layer is between about 10 and 100 SCFM/$ft^2$ $\frac{1}{2}$ inch water gauge differential pressure.

7. Apparatus according to claim 6 wherein the porous layer is a fabric insulating layer selected from a polypropylene fabric, an asbestos fabric and a nylon fabric.

8. Apparatus according to claim 3 wherein the conductive particles form a cathode bed, held between said porous insulating layer and a metallic current conductor plate.

9. Apparatus according to claim 3 in which the conducting particles are composed of materials selected from the group consisting of graphite, tungsten carbide, and conducting and non-conducting substrates coated with metals selected from gold, platinum and iridium or with metal oxides from the group lead dioxide and manganese dioxide.

* * * * *